US005199374A

United States Patent [19]

Blanchette

[11] Patent Number: 5,199,374

[45] Date of Patent: Apr. 6, 1993

[54] AERIAL LOCATION SELF-ACTUATING EMERGENCY SEA SURFACE MARKER FOR CAPSIZED VESSELS

[76] Inventor: Paul Blanchette, Rte. 15A, Sunset, Me. 04683

[21] Appl. No.: 824,577

[22] Filed: Jan. 23, 1992

[51] Int. Cl.[5] ..... B63B 22/12

[52] U.S. Cl. ..... 116/209; 116/210; 116/26; 441/7; 441/10

[58] Field of Search ..... 116/209, 210, 211, DIG. 8, 116/DIG. 9, 26, 27; 441/6, 7, 8, 9, 10, 11, 12, 13, 14, 15, 16, 17, 18, 19, 20, 26, 30, 31, 95

[56] References Cited

U.S. PATENT DOCUMENTS

| | | | |
|---|---|---|---|
| 1,117,639 | 11/1914 | Cooey | 441/95 |
| 1,295,805 | 2/1919 | Shafer | 441/25 |
| 1,771,730 | 7/1930 | Marcks | 441/30 |
| 2,754,525 | 7/1956 | Johnson, Jr. | 441/27 |
| 2,903,718 | 9/1959 | Wright | 441/10 |
| 3,031,693 | 5/1962 | Kirby | 441/26 |
| 3,123,842 | 3/1964 | Oeland et al. | 441/9 |
| 3,221,932 | 12/1965 | Anderson | 222/5 |
| 3,280,549 | 10/1966 | Shu | 441/9 |
| 3,425,390 | 2/1969 | Salmi | 116/210 |
| 3,811,144 | 5/1974 | Yamanka | 441/30 |
| 4,102,296 | 7/1978 | Felix | 116/210 |
| 4,240,371 | 12/1980 | Perry | 116/210 |
| 4,586,456 | 5/1986 | Forward | 116/210 |
| 4,627,823 | 12/1986 | Mackal | 441/95 |
| 4,809,638 | 3/1989 | Kolesar et al. | 116/26 |
| 5,020,467 | 6/1991 | Van Patten et al. | 116/210 |

FOREIGN PATENT DOCUMENTS

| | | | |
|---|---|---|---|
| 2451721 | 5/1976 | Fed. Rep. of Germany | 116/210 |
| 3702448 | 8/1988 | Fed. Rep. of Germany . | |
| 2473200 | 7/1981 | France . | |
| 0712981 | 9/1966 | Italy . | |

*Primary Examiner*—William A. Cuchlinski, Jr.
*Assistant Examiner*—W. Morris Worth
*Attorney, Agent, or Firm*—Daniel Kane

[57] ABSTRACT

An emergency location marker system for capsized vessels is housed in an emergency location marker canister or container (10) secured by a bracket (22) to an exposed or outside surface of the vessel (60). An inflatable aerial location marker (40) is deflated and folded in the small space of the canister. The aerial location marker is formed to provide upon inflation a relatively large surface area flat configuration to blanket a sufficient area of the sea surface for high visibility. The high visibility sea surface area blanketing marker (40) is formed with at least one flexible joint (41) for responding flexibly to wave motion while adhering to the sea surface. The sea surface area marker may be in a flat circular configuration, for example six feet in diameter and formed with a high visibility color. Flexible joints (41) along intersecting diameters permit flexing of the flat circular configuration marker in response to waves from all directions. A source of compressed air or gas such as a compressed air cylinder (36) is also housed in the canister (10) coupled to the inflatable marker bladder. A valve (38) on the compressed air cylinder or cartridge is activated by water immersion to inflate the bladder. The canister is comprised of separable segments constructed with break seams (32a,34) for opening or exploding in response to inflation of the location marker for releasing the inflating bladder. The canister also incorporates a feed line (44) for example on a rotating spool (26). One end (46) of the line is secured to the vessel and the other end to the location marker.

15 Claims, 5 Drawing Sheets

AERIAL LOCATION SELF-ACTUATING EMERGENCY SEA SURFACE MARKER FOR CAPSIZED VESSELS

TECHNICAL FIELD

This invention relates to a new inflatable marker or buoy for locating, identifying, and recovering fishing boats, aircraft, and other vessels lost at sea and sunk below the water surface. The location, identification, and recovery sea surface marker is stored in a canister on the outside of the vessel. Inflation from a pressurized source of gas is actuated by a capsized condition of the boat or other craft. The new marker rises to the water surface blanketing a sufficient surface area with high visibility material for location by aerial search.

BACKGROUND ART

A number of United States patents describe devices for releasing a balloon or buoy from an object sinking at sea. In the Felix U.S. Pat. No. 4,102,296, an actuator of a marine safety signal device on a sinking vessel inflates a balloon. The balloon rises to the surface of the water and into the air above the water surface. The balloon may carry a radar reflector. The emergency signal balloon apparatus disclosed by Salmi in U.S. Pat. No. 3,425,390 also deploys a balloon into the air over a vessel.

In the Oeland et al. U.S. Pat. No. 3,123,842 a pair of inflated balloon buoys are released from an object at the bottom of the sea by a combination of chemical action and pressure sensitive response. The chemical action is provided by electrolytic disintegration of a magnesium washer. Gas pressure then moves a piston for inflating the balloon like buoys 64. The Wright U.S. Pat. No. 2,903,718 describes an automatic marker buoy secured to an outboard motor. A pressure actuated spike punctures a compressed gas container if the outboard motor sinks inflating the round marker buoy.

Two of the references, the Kirby U.S. Pat. No. 3,031,693 and the Perry U.S. Pat. No. 4,240,371 describe signal buoys or bladders for divers. The Kirby marker buoy is of interest because it is flat and rectangular in shape rather than spherical. The diver carries the marker buoy folded in a belt pouch. When the diver finds an object to be identified the marker buoy is inflated and secured to the object by a line. The flat marker buoy rises to the surface and floats on the surface. However it is of very small dimensions, apparently on the width of, for example, the diver's hand.

The Jui-Cheng Shu U.S. Pat. No. 3,280,549 describes a release mechanism using a cartridge of material expandable in water "for use in various types of safety or emergency equipment such as aboard ships". U.S. Pat. Nos. 4,586,456 and 1,771,730 are of related interest.

OBJECTS OF THE INVENTION

It is an object of the present invention to provide a new sea surface location marker for blanketing a sufficient sea surface area for high visibility and for effective aerial location and identification at sea by search planes.

Another object of the invention is to provide an aerial location marker or buoy system stored in compact form on a vessel and automatically actuated by a capsized condition such as water or pressure for indicating from the sea surface the location of the vessel under the sea.

As used herein, the word vessel is intended to include both aircraft and watercraft.

A further object of the invention is to provide a new large area sea surface location marker or buoy of flat configuration which responds flexibly to waves and "adheres" to the sea surface.

DISCLOSURE OF THE INVENTION

In order to accomplish these results, the invention provides a new emergency location marker system for capsized vessels. An emergency location marker canister or container is secured by a bracket to an exposed or outside surface of the vessel. The invention provides an inflatable location marker deflated and folded in the small space of the canister.

According to the invention the aerial location marker is formed to provide upon inflation a relatively large surface area flat configuration to blanket a sufficient area of the sea surface for high visibility. A feature of the invention is that the high visibility sea surface area blanketing marker is formed with at least one flexible joint for responding flexibly to wave motion while adhering to the sea surface.

According to the preferred example embodiment, the sea surface area marker may be in a flat circular configuration, for example six feet in diameter and formed with a high visibility color. Flexible joints along intersecting diameters permit flexing of the flat circular configuration marker in response to waves from all directions.

A source of compressed air or gas such as a compressed air cylinder or helium or $CO_2$ cartridge is also housed in the canister coupled to the inflatable marker bladder. A valve on the compressed air cylinder or cartridge is activated by water immersion to inflate the bladder.

A feature of the emergency location marker canister is that it is comprised of separable segments constructed with break seams for opening or exploding in response to inflation of the location marker for releasing the inflating bladder. In the preferred cylindrical configuration container, a first break seam divides the container into upper and lower fractions. A second break seam divides the upper fraction into halves along an axial direction.

In its lower section the canister also incorporates a feed line for example on a rotating spool. One end of the line is secured to the vessel and the other end to the location marker. A length of monofilament line is provided of sufficient length with play, e.g., 1200–2000 feet for the depths in which the fishermen typically operate.

The operation of the invention is as follows. The water sensitive switch or valve activates under pressure or immersion in water to release air from the compressed air cartridge. This in turn initiates filling the inflatable blanket configuration sea surface marker with pressurized air and explodes the canister. As the ship or aircraft sinks, the blanket-like marker rises to the surface. The line is secured at one end to a harness formed on the sea surface blanketing marker and at the other end to the cylinder and boat. It feeds out through the open end of the canister. The blanket-like sea surface marker is formed with foldable or bendable seams or joints across the surface so that the sea blanket responds flexibly to wave motion and adheres to the surface. The inflated sea blanket, therefore, tends not to fold over or turn over in the waves. The inflated sea surface blanketing marker is appropriately colored day glow orange for visibility by day and reflection tape affords greater visibility at night.

It is important to note a particular feature of the present invention in using an inflatable, bendable and foldable flat configuration "sea blanketing" marker for high visibility to facilitate aerial location of a sunken object. This feature of the invention differs from prior art rescue location devices using spherical buoys and balloons described above. The high visibility blanket sea surface location marker of the present invention is adapted for greater visibility on the surface of the sea to facilitate aerial identification and location.

Other objects, features and advantages of the invention are set forth in the following specification and accompanying drawings.

DESCRIPTION OF PREFERRED EXAMPLE EMBODIMENTS AND BEST MODE OF THE INVENTION

Figure 1:
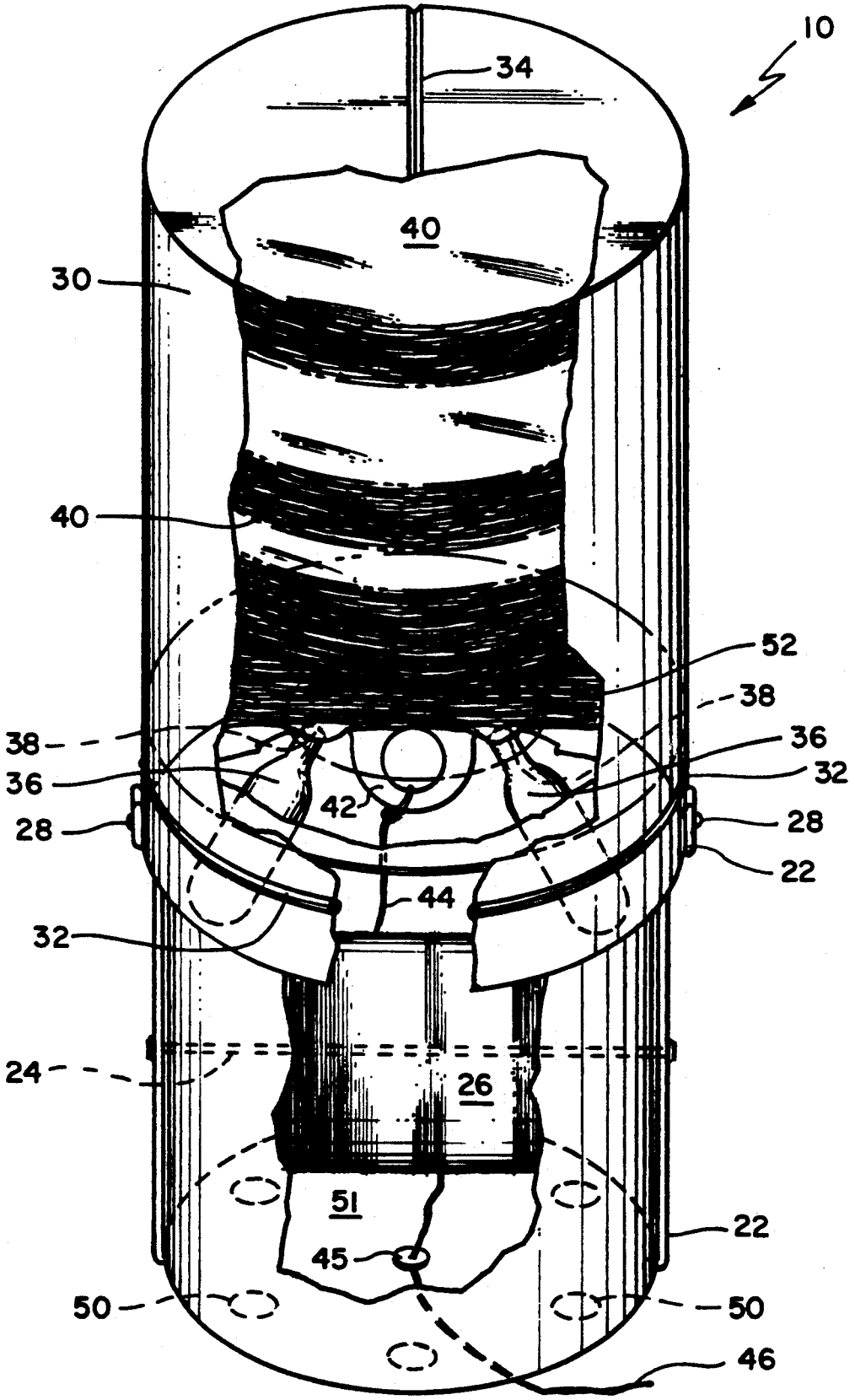
FIG. 1 is a perspective view of the sea surface location marker canister 10 with mounting bracket 22, also showing the folded sea surface blanketing marker 40 and line spool 26. Air or gas cylinders 36 are attached and ready for activation.

FIG. 1 shows an emergency sea surface location marker canister 10 with mount bracket 22. The bracket has a ⅜ inch stainless steel shaft pin 24 that extends through line spool 26. The bracket 22 also has secondary pins 28 on the upper part of canister 10. The canister is made of a durable plastic in multiple sections. Upper section or blanket marker section 30 has a rubber seal 32 formed around the circumference where it joins and engages the lower section for easier parting of the canister at the circumference. Also, the upper fraction or section 30 of canister 10 is formed with a break seam 34 along the axial direction of the cylindrical canister for quick release of the inflating sea surface blanket location marker 40.

Compressed air cylinders 36 are located in the canister and are connected to the air inlet of the blanket location marker 40. The sea surface location marker 40 may be equipped with check valves which permit air to pass into but not out of the sea blanket. The blanket location marker is provided with a reinforced harness 42 to support one end 43 of the line 44 which goes through a partition and onto spool 26. The remaining end 46 of line 44 comes out through rubber seal 45 at the bottom end of canister 45. Line 44 is securely fastened to the vessel 60 at end 46.

Figure 1A:
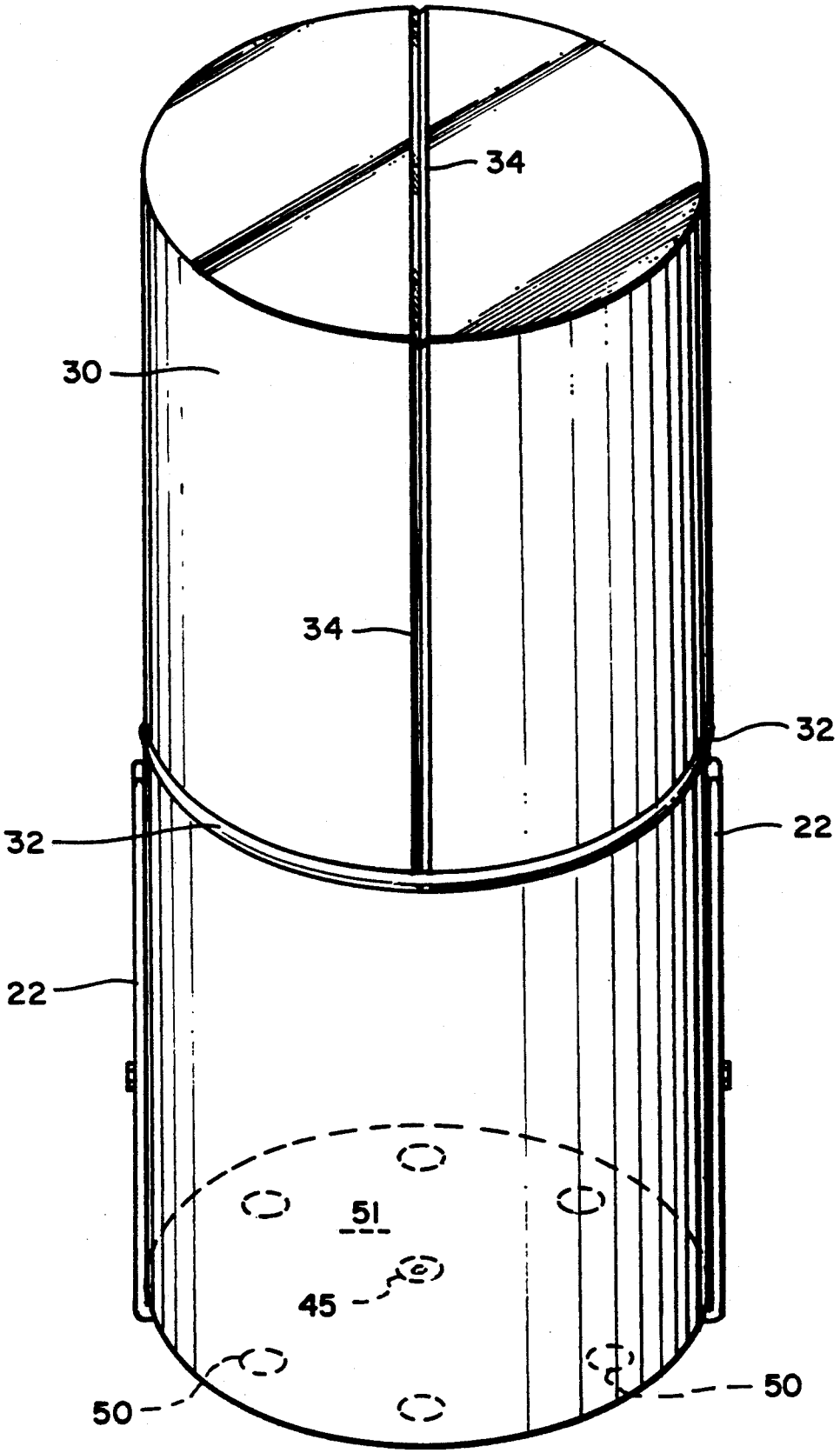
FIG. 1A is a perspective view of another embodiment of the sea surface location marker canister 10 with mount bracket 22. In this embodiment a break seam 32*a* with rubber seal is formed around the waist of the canister.
Figure 1B:
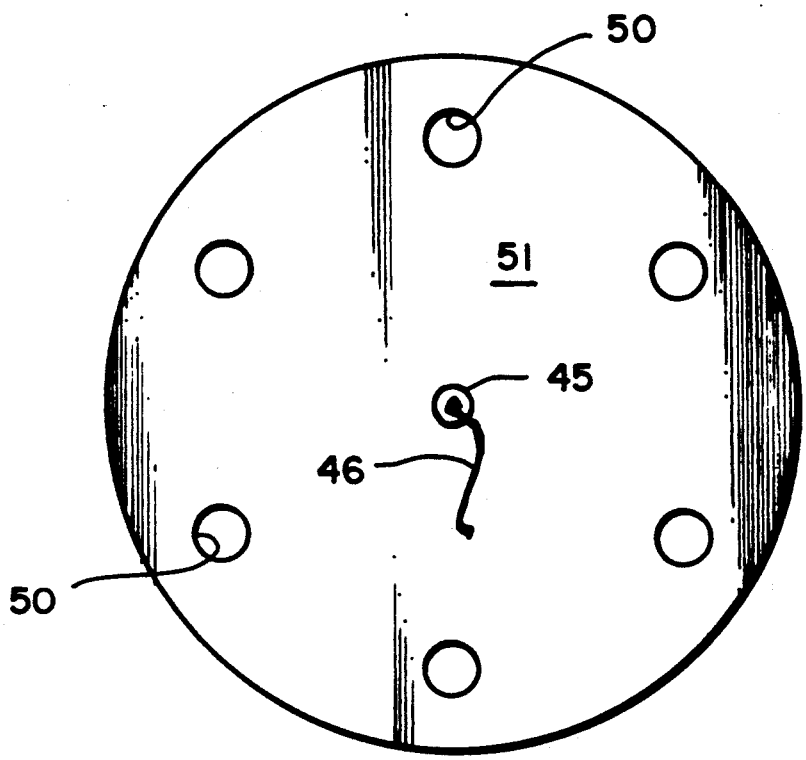
FIG. 1B is plan view of the bottom 51 of the canister 10 showing holes 50 for receiving water for activating the valves 38 on the compressed air cylinders.

Holes 50 are formed in the bottom cavity or lower surface 51 of lower section 31 for penetration of water to activate inflator valves 38 on air cylinders 36 as shown in FIG. 1B. The holes 50 also drain unwanted water or moisture from the container during normal vessel operations.

An automatic control valve 38 suitable for the emergency sea surface location marker is the SOSPENDERS (TM) Automatic Model which initiates inflation approximately 5 seconds after immersion in water. The SOSPENDERS (TM) Automatic Model can be obtained from Sporting Lives, Inc. P.O. Box 518, Meridian, Idaho 83642. Rearming kits including replacement compressed gas cartridges may also be obtained form this source.

In the alternative embodiment of FIG. 1A, the canister is formed with a first break seam 32*a* formed around the circumference or waist of the canister 10 which may be formed with a rubber seal. The first break seam 32*a* divides the canister into upper and lower sections. The upper section 30 is in turn formed with a second break seam 34 in an axial direction for dividing and breaking the upper section into halves in response to inflation of the bladder 40.

Figure 2:
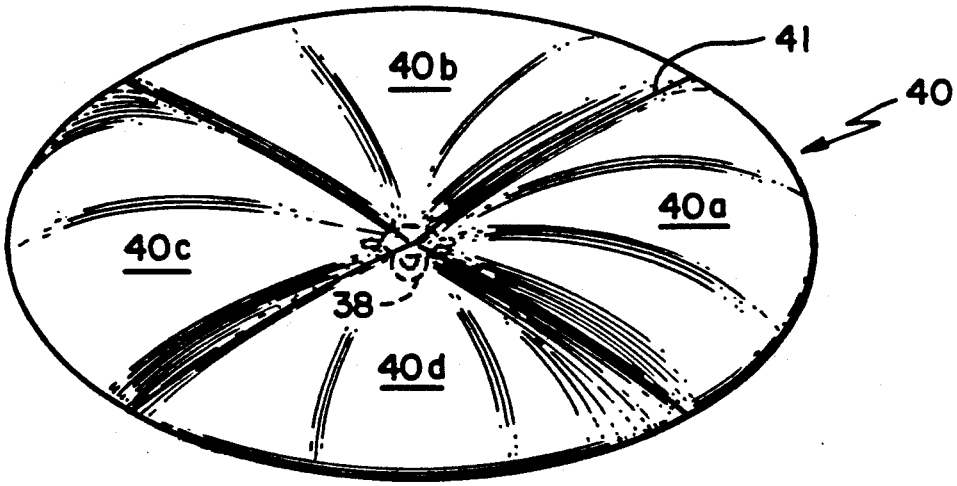
FIG. 2 is a perspective view of the sea surface location marker 40 fully inflated as seen from the air.
Figure 3:
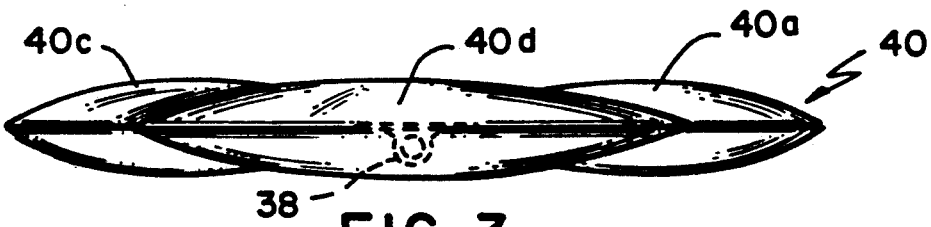
FIG. 3 is a side view of the sea surface location marker 40 of FIG. 2.

As shown in FIGS. 2 & 3, the flat circular configuration sea surface marker 40 is formed with flexible joints 41 along intersecting diameters of the circle. The intersecting diameter flexible joint lines 41 permit omnidirectional flexing of the marker 40 in response to waves from all directions. In the examples of FIGS. 2–5 the flex lines 41 intersect at right angles dividing the marker 40 into quadrants 40*a*, 40*b*, 40*c*, 40*d*.

Figure 4:
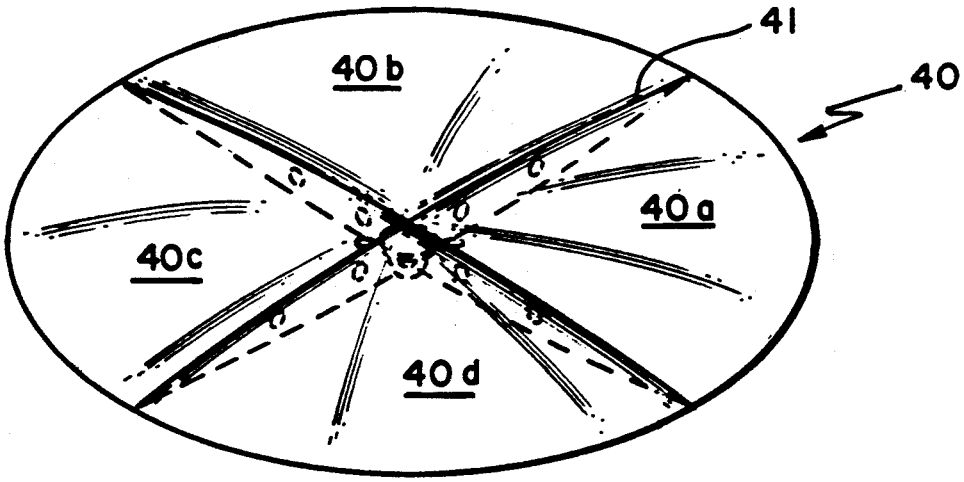
FIG. 4 is a perspective view of an alternative sea surface location marker 40*a* with a reinforced harness and flexible inner baffles at the flexible joints.
Figure 5:
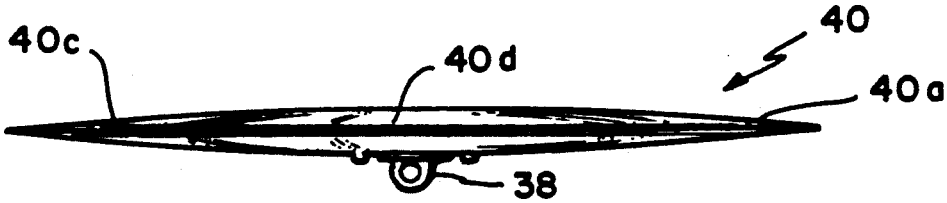
FIG. 5 is a side view of the alternative sea surface location marker 40*a*.

An alternative embodiment of the sea surface location marker 40 is illustrated in FIGS. 4 and 5. Flexible membrane baffles 54 formed with air passage holes 55 are provided along the joint lines between quadrants to facilitate passage of air during inflation. In the embodiment of FIGS. 2 and 3, each quadrant may be separately inflated and/or openings may be provided between quadrants.

Figure 6:
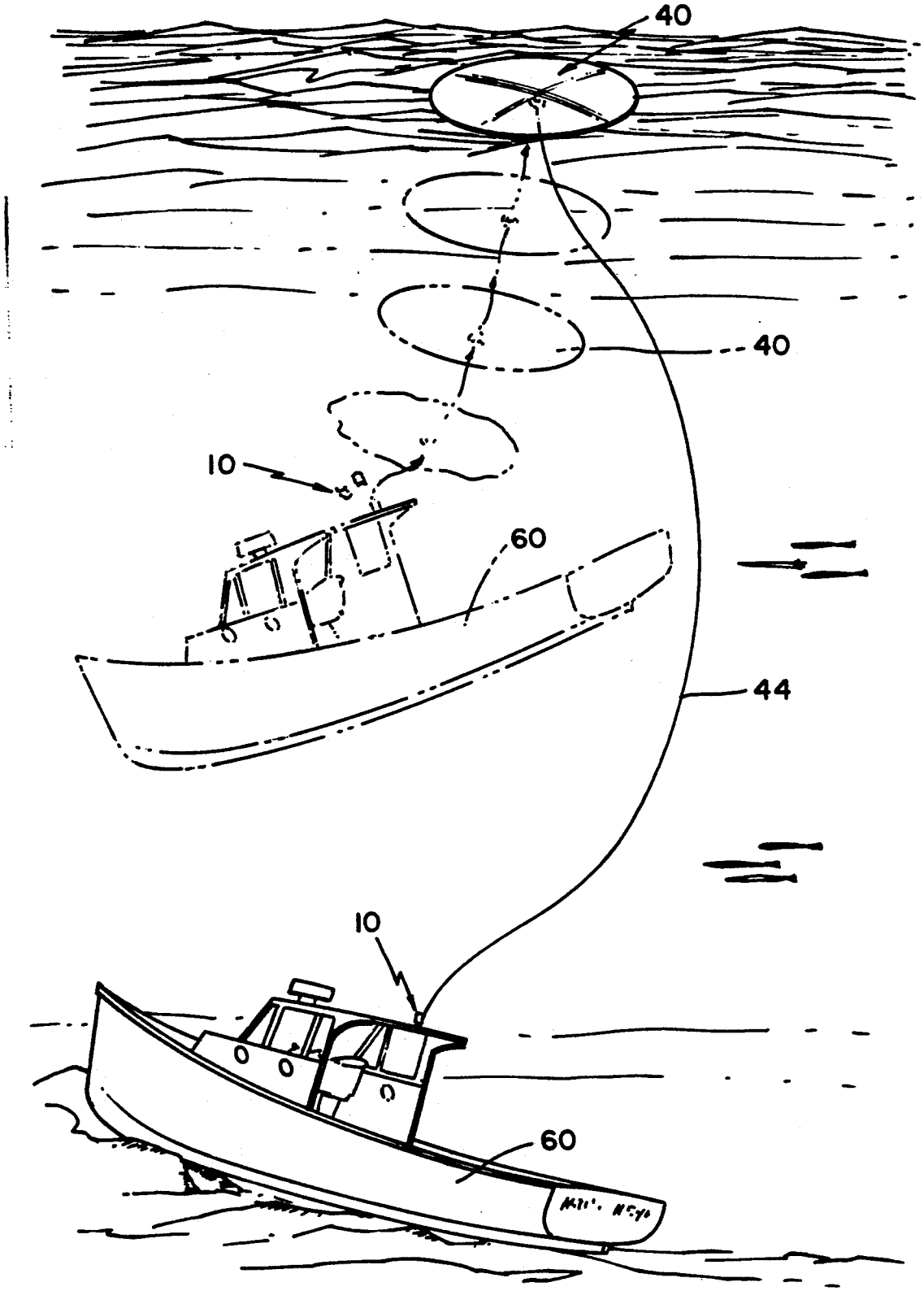
FIG. 6 is an environmental view showing the sea surface location marker 40 being deployed from a sinking vessel.

The environmental view of FIG. 6 shows the operation of the invention. The capsized condition of the vessel immerses the canister 10 in water, activates the sensor valve 38 by water or pressure and inflates bladder 40, bursting the canister 10. The high visibility sea surface marker 40 floats to the surface, secured by line 44, marking the location of the sunken vessel 60.

While the invention has been described with reference to particular example embodiments it is intended to cover all modifications and equivalents within the scope of the following claims.

I claim:

1. An emergency location marker system for capsized vessels comprising:

a location marker container and bracket for securing the container to an exposed or outside surface of a vessel;

an inflatable sea surface location marker means formed in a relatively large surface area flat configuration for floating on the surface of the sea and blanketing a sufficient surface area of the sea for high visibility location by aerial search, said location marker means having at least one flexible joint thereacross permitting said location marker means to flex in response to wave motion while adhering to the sea surface;

a source of compressed gas coupled to the inflatable sea surface location marker means, said location marker means and source of compressed gas being housed in the container;

and a sensor valve means coupled between the source of compressed gas and location marker means responsive to one of water and pressure within the container caused by a capsized condition of the vessel to leave air from the source of compressed gas for inflating the sea surface location marker means;

said container comprising separable segments constructed with at least one break seam for opening in response to inflation of the location marker means for releasing the inflated location marker means;

and a line stored in the container, said line being secured at one end to the vessel and at the other end to the location marker means.

2. The location marker system of claim 1 wherein the container is a cylindrical configuration container with said at least one break seam circumference around the cylindrical configuration container and dividing the cylindrical configuration container into upper and lower fractions, and including a second longitudinal break seam dividing the upper fraction substantially in half in the axial direction.

3. The location marker system of claim 1 wherein the container is formed with drain holes distributed on a bottom surface of the container for admitting water when said vessel is in a capsized condition to actuate the sensor valve means and for drainage of water and moisture away from the container during normal operation of the vessel.

4. The location marker system of claim 1 wherein the sea surface location marker means is formed in a flat circular configuration.

5. The location marker system of claim 4 wherein the location marker means is at least six feet in diameter.

6. The location marker system of claim 4 wherein the flexible joint is along a diameter.

7. The location marker system of claim 6 wherein the location marker means includes a second flexible joint along a diameter; said joints intersecting and permitting flexing of the location marker means in response to waves from all directions.

8. An emergency location marker system for vessels lost at sea below the water surface comprising:

an inflatable sea surface location marker constructed to form upon inflation a relatively large surface area flat configuration for blanketing a sufficient sea surface area for high visibility location by aerial search, said inflatable sea surface location marker being formed with at least one flexible joint for permitting said marker to flex in response to wave motion while adhering to the sea surface;

a location marker system container for storing the sea surface location marker in deflated folded form in a relatively small volume and bracket means for securing the container to an outside surface of a vessel;

a source of compressed gas and a sensor valve means for coupling the source of compressed gas to the inflatable sea surface location marker in the container, said sensor valve means being responsive to one of water and pressure in the container caused by a capsized condition of the vessel to inflate the location marker from the source of compressed gas;

said container comprising separable segments constructed with at least one break seam for breaking open in response to inflation of the location marker for releasing the inflated location marker;

and a line stored in the container secured at one end to the vessel and at the other end to the location marker.

9. The location marker system of claim 8 comprising a spool for the line rotatably mounted within the container, one end of the line being secured to the sea surface location marker, and the other end of the line being secured to the vessel.

10. The location marker system of claim 8 wherein the container is formed with drain holes distributed over a bottom surface of the container for admitting water when said vessel is in a capsized condition and for draining water and moisture from the container during normal operation of the vessel.

11. The location marker system of claim 8 wherein the container is formed in cylindrical configuration with said at least one break seam dividing the cylindrical configuration container into upper and lower fractions, and includes a second break seam dividing the upper fraction of the cylindrical configuration container in two parts along an axial direction of the cylindrical configuration container.

12. The location marker system of claim 8 wherein the sea surface location marker is formed in a flat circular configuration.

13. The location marker system of claim 12 wherein the circular configuration location marker includes a second flexible joint, said joints being along diameters of said location marker and intersecting for permitting flexing of the marker in response to waves from all directions while adhering to the water surface.

14. The location marker system of claim 8 wherein the relatively large surface area flat configuration location marker is formed with at least two flexible joints extending across the location marker and intersecting each other approximately at right angles permitting said location marker to flex in response to wave motion for all directions.

15. The location marker system of claim 8 wherein the relatively large surface area flat configuration location marker is formed with at least two flexible joints extending across the location marker and intersecting each other approximately at right angles for permitting said location marker to flex in response to wave motion for all directions.

* * * * *